US011194282B1

(12) United States Patent
Iguchi

(10) Patent No.: US 11,194,282 B1
(45) Date of Patent: Dec. 7, 2021

(54) IMAGE FORMING APPARATUS AND CONTROL METHOD FOR COLLECTING WASTE TONER IN A WASTE TONER COLLECTION CONTAINER

(71) Applicant: TOSHIBA TEC KABUSHIKI KAISHA, Tokyo (JP)

(72) Inventor: Ken Iguchi, Numazu Shizuoka (JP)

( * ) Notice: Subject to any disclaimer, the term of this patent is extended or adjusted under 35 U.S.C. 154(b) by 0 days.

(21) Appl. No.: 17/148,708

(22) Filed: Jan. 14, 2021

(51) Int. Cl.

| | |
|---|---|
| ***G03G 21/10*** | (2006.01) |
| ***G03G 21/12*** | (2006.01) |
| ***G03G 15/08*** | (2006.01) |
| ***G03G 21/20*** | (2006.01) |

(52) U.S. Cl.
CPC ..... *G03G 21/12* (2013.01); *G03G 15/0889* (2013.01); *G03G 21/203* (2013.01)

(58) Field of Classification Search
CPC ..... G03G 21/10; G03G 21/12; G03G 21/105; G03G 21/20; G03G 21/203
USPC ..... 399/35, 44, 358, 360
See application file for complete search history.

(56) References Cited

U.S. PATENT DOCUMENTS

| | | | | |
|---|---|---|---|---|
| 7,991,308 | B2 * | 8/2011 | Oh | G03G 21/12 399/35 |
| 2007/0196148 | A1 | 8/2007 | Shishikura | |
| 2020/0233367 | A1 * | 7/2020 | Sugiyama | G03G 21/105 |

FOREIGN PATENT DOCUMENTS

| | | |
|---|---|---|
| JP | 2004-045451 | 2/2004 |
| JP | 2005-227730 | 8/2005 |
| JP | 2010-160319 | 7/2010 |

* cited by examiner

*Primary Examiner* — William J Royer
(74) *Attorney, Agent, or Firm* — Amin, Turocy & Watson, LLP

(57) ABSTRACT

According to one embodiment, an image forming apparatus includes an image forming unit, an environmental sensor, a waste toner collection container, a paddle motor, a storage unit, and a control unit. The image forming unit is configured to forma toner image on a sheet using a toner that is replenished from a toner cartridge containing the toner. The environmental sensor is configured to acquire information regarding an environment around the image forming unit. The waste toner collection container is configured to contain a waste toner produced in the image forming unit. The paddle motor is configured to rotate a stirring paddle provided in the waste toner collection container. The storage unit is configured to store a correction factor corresponding to the information regarding the environment acquired by the environmental sensor. The control unit is configured to acquire a count value as a value relating to a replenishment amount when the toner is replenished from the toner cartridge to the image forming unit. The control unit is configured to correct the count value with the correction factor corresponding to the information regarding the environment. The control unit is configured to update a cumulative count value with the corrected count value. The control unit is configured to drive the paddle motor according to the updated cumulative count value.

20 Claims, 5 Drawing Sheets

IMAGE FORMING APPARATUS AND CONTROL METHOD FOR COLLECTING WASTE TONER IN A WASTE TONER COLLECTION CONTAINER

FIELD

Embodiments described herein relate generally to an image forming apparatus and a control method.

BACKGROUND

In the related art, in an image forming apparatus using toner, a mechanism of collecting waste toner is used. For example, toner remaining on a drum unit during transfer from the drum unit to an intermediate transfer belt or toner remaining on the intermediate transfer belt during transfer from the intermediate transfer belt to paper is collected as the waste toner. This waste toner is stored in a waste toner collection container such as a waste toner box. In the waste toner collection container, a stirring paddle is provided, for example, in order to level the waste toner in the container. In order to control the stirring paddle, for example, a control of operating the stirring paddle when an increase in the amount of the waste toner in the container exceeds a predetermined value may be adopted.

However, there is a problem in that waste toner is likely to accumulate at a specific position due to an operation environment of an image forming apparatus. When the waste toner accumulates at the specific position, for example, although the waste toner collection container has a room to store the waste toner, the toner accumulation is detected by a sensor, and a notification to urge the replacement is given. Therefore, it may be difficult to efficiently utilize the waste toner collection container.

DETAILED DESCRIPTION

In general, an image forming apparatus according to one embodiment includes an image forming unit, an environmental sensor, a waste toner collection container, a paddle motor, a storage unit, and a control unit. The image forming unit is configured to form a toner image on a sheet using a toner that is replenished from a toner cartridge containing the toner. The environmental sensor is configured to acquire information regarding an environment around the image forming unit. The waste toner collection container is configured to contain a waste toner produced in the image forming unit. The paddle motor is configured to rotate a stirring paddle provided in the waste toner collection container. The storage unit is configured to store a correction factor corresponding to the information regarding the environment acquired by the environmental sensor. The control unit is configured to acquire a count value as a value relating to a replenishment amount when the toner is replenished from the toner cartridge to the image forming unit. The control unit is configured to correct the count value with the correction factor corresponding to the information regarding the environment. The control unit is configured to update a cumulative count value with the corrected count value. The control unit is configured to drive the paddle motor according to the updated cumulative count value.

Figure 1:
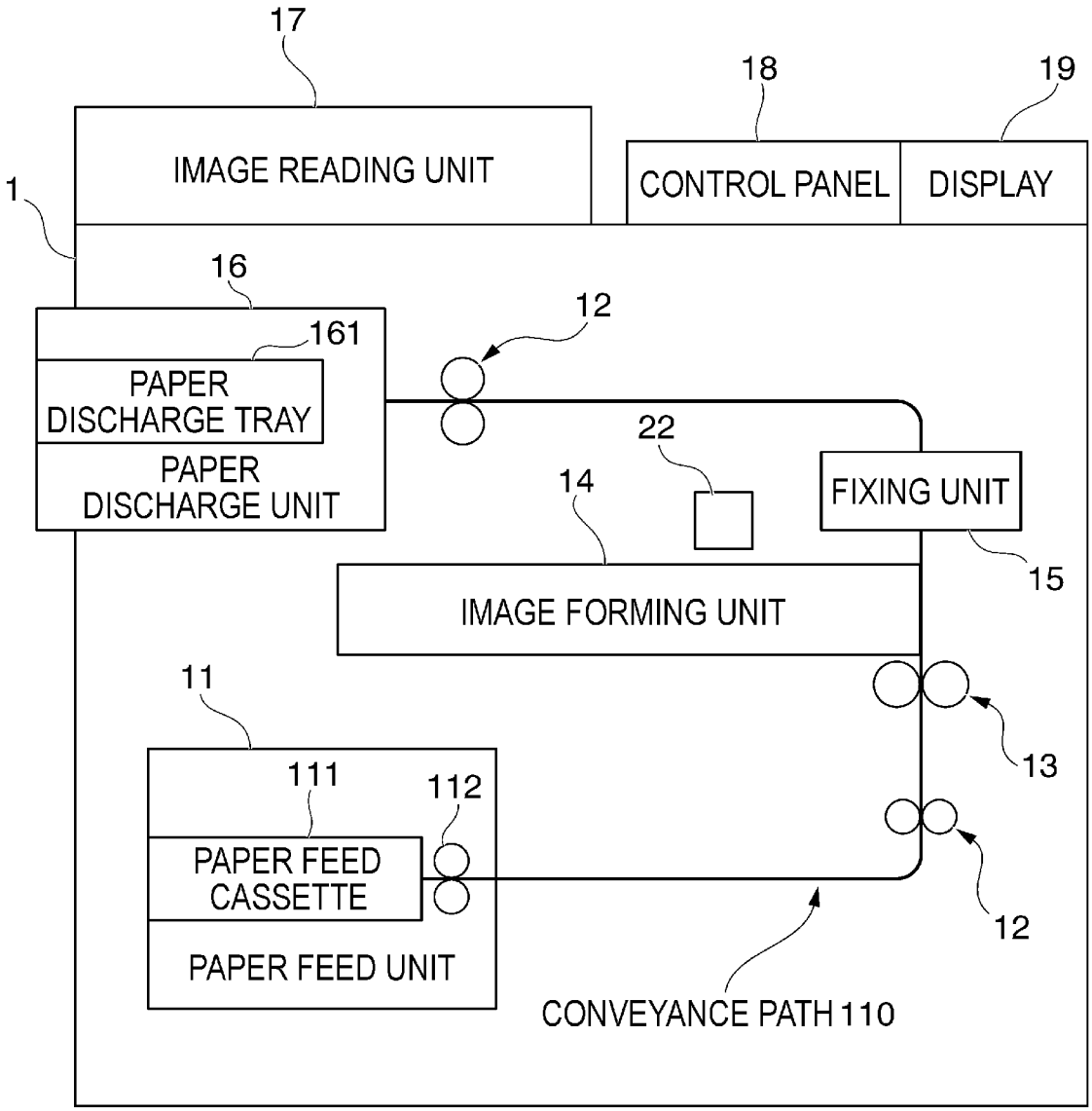
FIG. 1 is a diagram illustrating a configuration example of an image forming apparatus according to an embodiment.
Figure 2:
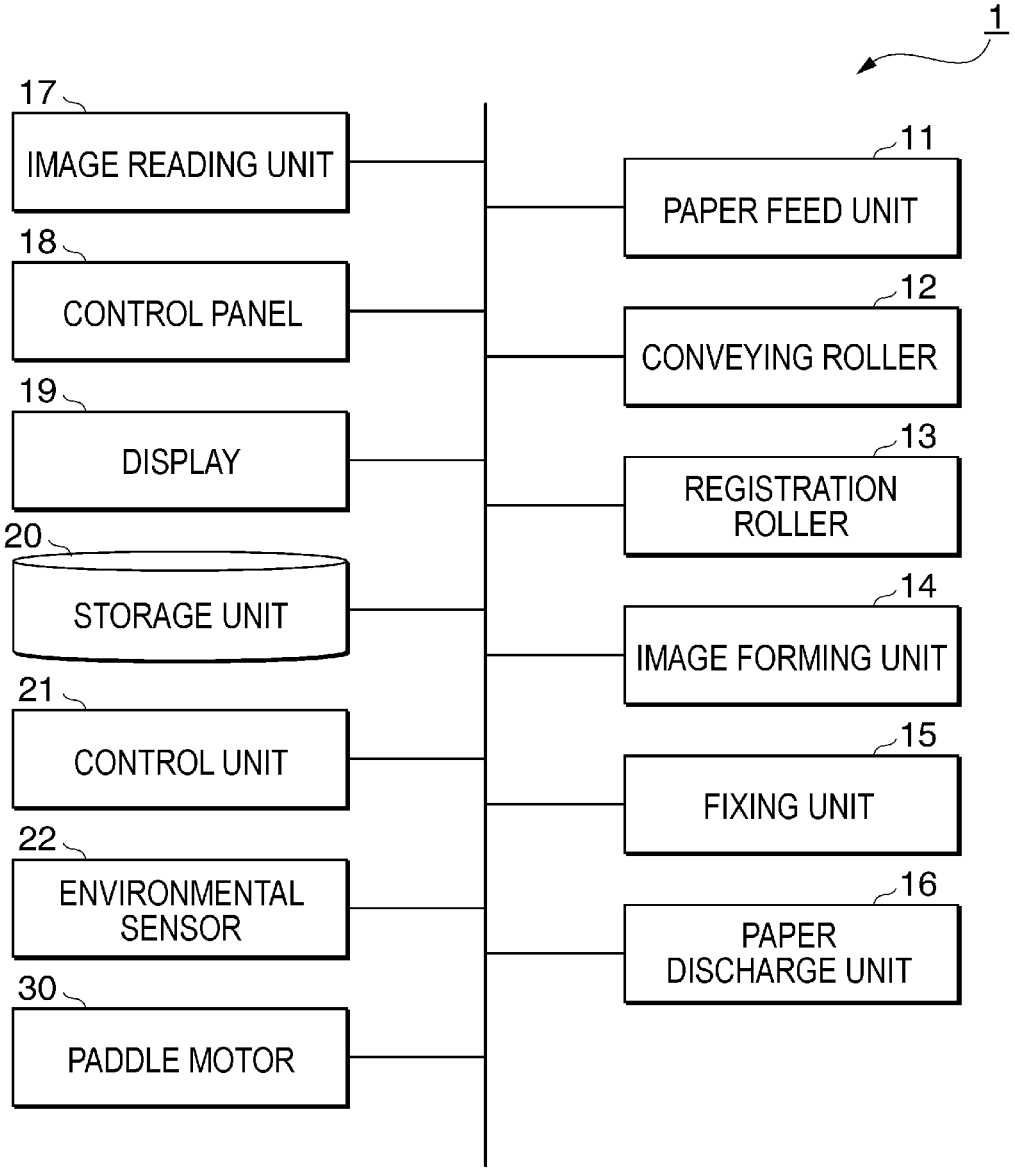
FIG. 2 is a hardware block diagram illustrating the image forming apparatus according to the embodiment.

Hereinafter, an image forming system and a control method according to an embodiment will be described with reference to the drawings. FIG. 1 is a diagram illustrating a configuration example of an image forming apparatus 1 according to the embodiment. FIG. 2 is a hardware block diagram illustrating the image forming apparatus 1 according to the embodiment. First, the image forming apparatus 1 will be described using FIGS. 1 and 2.

The image forming apparatus 1 includes a paper feed unit 11, a plurality of conveying rollers 12, a registration roller 13, an image forming unit 14, a fixing unit 15, a paper discharge unit 16, an image reading unit 17, a control panel 18, a display 19, a storage unit 20, a control unit 21, an environmental sensor 22, and a paddle motor 30. The image forming apparatus 1 forms an image on a sheet with a developer such as toner. The sheet is, for example, paper or label paper. The sheet may be any material as long as the image forming apparatus 1 can form an image on a surface of the sheet.

The paper feed unit 11 includes a paper feed cassette 111 and a paper feed roller 112. The paper feed cassette 111 stores one or a plurality of sheets. The paper feed roller 112 rotates to pick up one sheet accommodated in the paper feed cassette 111 and supplies the picked sheet to a conveyance path 110.

In the image forming apparatus 1, the conveyance path 110 through which a sheet as a target on which an image is to be formed is conveyed is provided. The conveyance path 110 is formed by providing a plurality of conveying rollers 12 in a space through which a sheet can pass. The conveying rollers 12 are driven by a motor to rotate so that the sheet positioned in the conveyance path 110 is conveyed.

The registration roller 13 is provided halfway the conveyance path 110. In general, the registration roller 13 is provided in front of a transfer unit of the image forming unit 14. The sheet conveyed by the conveyance path 110 abuts against the registration roller 13 that does not rotate so that the inclination of the sheet is corrected. Next, when the registration roller 13 rotates, the sheet in which the inclination is corrected enters the image forming unit 14.

The image forming unit 14 forms an image on the sheet conveyed through the conveyance path 110 based on image information generated by the image reading unit 17 or received image information. The image forming unit 14 includes, for example, a developing unit and a transfer unit. The image forming unit 14 forms an image through, for example, the following processes. The developing unit of the image forming unit 14 forms an electrostatic latent image on a photoconductive drum based on the image information. The developing unit of the image forming unit 14 applies a toner to the electrostatic latent image to form a visible image. The transfer unit of the image forming unit 14 transfers the visible image to the sheet.

The fixing unit 15 applies heat and pressure to the sheet to fix the visible image to the sheet.

The paper discharge unit 16 includes a paper discharge tray 161. The sheet to which the visible image is fixed is discharged to the paper discharge unit 16. For example, the sheet conveyed through the conveyance path 110 may be biased by the conveying rollers 12 and discharged to the paper discharge tray 161.

The image reading unit 17 is, for example, a scanner. The image reading unit 17 reads image information of a reading target based on brightness and darkness of light. The image reading unit 17 records the read image information. The recorded image information may be stored in the storage unit 20 of the image forming apparatus 1 or may be transmitted to another information processing apparatus via a network. Based on the recorded image information, the image forming unit 14 may form an image on the sheet.

The control panel 18 includes a keypad. The control panel 18 receives the operation of a user. In addition, the control panel 18 outputs a signal corresponding to the operation input by the user to the control unit 21 of the image forming apparatus 1.

The display 19 is an image display device such as a liquid crystal display or an organic electro luminescence (EL) display. The display 19 displays various information relating to the image forming apparatus 1. The control panel 18 and the display 19 may be configured to be integrated into a touch panel.

The storage unit 20 is configured using a storage device such as a magnetic hard disk device or a semiconductor memory device. The storage unit 20 stores data required to operate the image forming apparatus 1. The storage unit 20 may temporarily store or save data of an image to be formed by the image forming apparatus 1.

The control unit 21 is configured using a processor such as a Central Processing Unit (CPU) or a memory. The control unit 21 reads a program that is stored in the storage unit 20 in advance and executes the read program. The control unit 21 controls operations of the respective units in the image forming apparatus 1. The control unit 21 controls an operation of the image forming apparatus 1 in accordance with an operation that is executed by the user on the control panel 18.

The environmental sensor 22 is disposed around or in the image forming unit 14 and acquires information regarding an environment around or in the image forming unit 14. The environmental sensor 22 may acquire an information regarding an environment of one type of attribute or an information regarding an environment of plural types of attributes. One environmental sensor 22 or a plurality of environmental sensors 22 may be provided. When a plurality of environmental sensors 22 are provided, the sensors may have the same type or different types. For example, the environmental sensor 22 may acquire information regarding a temperature, information regarding a humidity, or another type of information.

The paddle motor 30 is driven in accordance with a control of the control unit 21. The paddle motor 30 rotates a stirring paddle described below.

Figure 3:
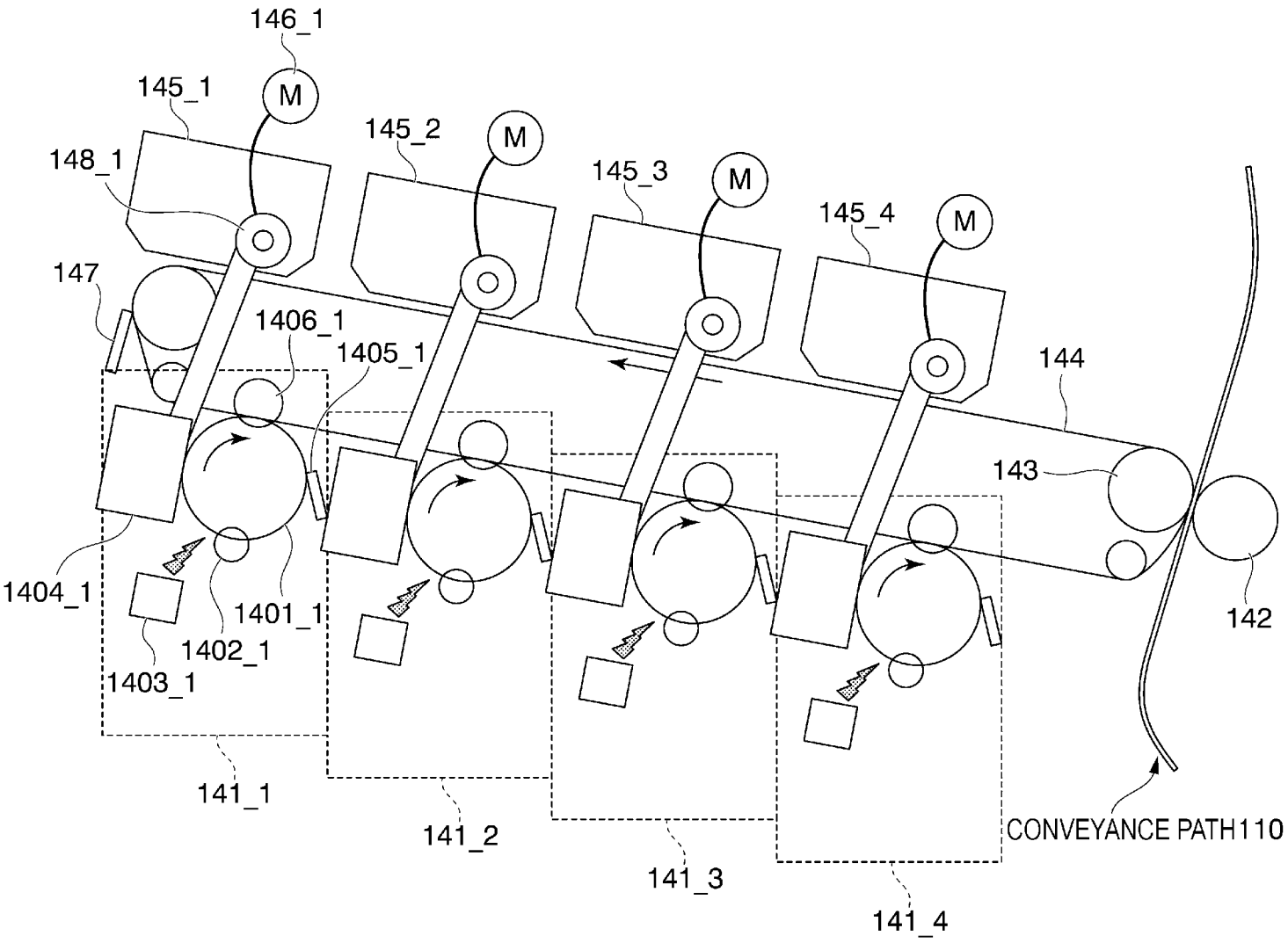
FIG. 3 is a diagram illustrating a configuration example of an image forming unit.

FIG. 3 is a diagram illustrating a configuration example of the image forming unit 14. The image forming unit 14 includes one or a plurality of process units 141, a secondary transfer roller 142, a secondary transfer facing roller 143, an intermediate transfer belt 144, one or a plurality of toner cartridges 145, one or a plurality of replenishment motors 146, a transfer cleaner 147, and a screw 148. The process unit 141, the toner cartridge 145, and the replenishment motor 146 are provided per type of toner. In the example of FIG. 3, types of toners include yellow (Y), magenta (M), cyan (C), and black (K). As a type of a toner, a toner different from the four toners may be used. For example, a decolorable toner, a fluorescent toner, or a decorative toner may be used. In FIG. 3, respective functional units corresponding to the respective color toners are distinguished from each other by assigning "_1", "_2", "_3", and "_4" thereto, respectively. For example, "141_1" represents a process unit 141 for yellow.

The process unit 141 forms a toner image on the intermediate transfer belt 144 as an endless belt. The process unit 141 includes a photoconductive drum 1401, a charging unit 1402, an exposure device 1403, a developing device 1404, a photoreceptor cleaner 1405, and a primary transfer roller 1406. Four process units 141 corresponding to Y, M, C, and K and having the same configuration are provided.

The photoconductive drum 1401 forms an electrostatic latent image on a surface thereof. The photoconductive drum 1401 is an image carrier. The photoconductive drum 1401 is, for example, a cylindrical drum. The photoconductive drum 1401 includes a photoreceptor material on an outer circumferential surface thereof and has a characteristic in which a portion irradiated with light discharges static electricity.

The charging unit 1402 charges the surface of the photoconductive drum 1401 with static electricity. The charging unit 1402 is, for example, a needle electrode.

The exposure device 1403 forms an electrostatic latent image of an image to be formed on the surface of the photoconductive drum 1401. The exposure device 1403 is, for example, a laser irradiation device.

The developing device 1404 supplies the toner to the surface of the photoconductive drum 1401 and develops the electrostatic latent image with the toner.

The photoreceptor cleaner 1405 removes residual toner on the photoconductive drum 1401. The removed toner is collected in a waste toner box 40 as waste toner.

The primary transfer roller 1406 transfers the electrostatic latent image developed on the surface of the photoconductive drum 1401 to the intermediate transfer belt 144.

The secondary transfer roller 142 transfers the toner image on the intermediate transfer belt 144 to the sheet.

The secondary transfer facing roller 143 is present at a position facing the secondary transfer roller 142 with the intermediate transfer belt 144 interposed therebetween. The sheet is interposed between the secondary transfer facing roller 143 and the secondary transfer roller 142, and the secondary transfer facing roller 143 conveys the sheet to which the image is transferred.

On one side of the intermediate transfer belt 144 in a longitudinal direction, the secondary transfer roller 142 and the secondary transfer facing roller 143 are provided. On another side of the intermediate transfer belt 144 in the longitudinal direction, the transfer cleaner 147 is provided. The transfer cleaner 147 removes residual toner on the intermediate transfer belt 144. The toner removed by the transfer cleaner 147 is collected in the waste toner box 40 as waste toner.

The toner cartridge 145 filled with the toner of each type is provided in the process unit 141.

The replenishment motor 146 is driven to rotate the screw 148 in the toner cartridge 145. In response to the rotation of the screw 148, the toner in the toner cartridge 145 moves and falls to the developing device 1404 through a pipe. Due to this operation, the toner in the toner cartridge 145 is replenished to the developing device 1404.

Figure 4:
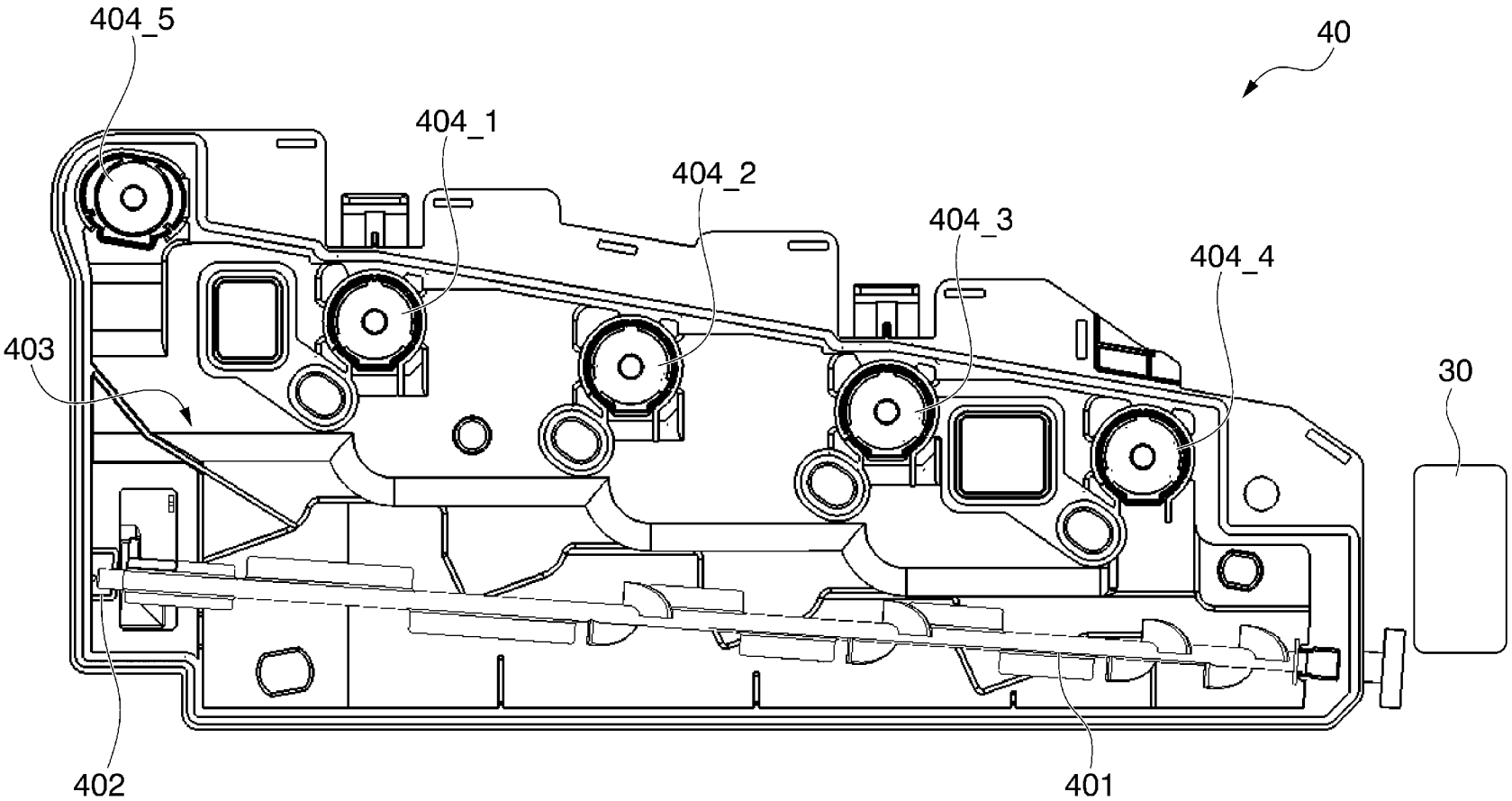
FIG. 4 is a diagram illustrating a configuration example of a waste toner box.

FIG. 4 is a diagram illustrating a configuration example of the waste toner box 40. The waste toner box 40 is configured to be attachable to and detachable from the image forming apparatus 1. The waste toner box 40 is a specific example of the waste toner collection container. The waste toner box 40 includes a stirring paddle 401, a detection unit 402, an accommodation unit 403, and a plurality of waste toner introduction ports 404.

The waste toner box 40 is mounted on the image forming apparatus 1 so that a gear connected to the stirring paddle 401 and the paddle motor 30 are connected. In response to the driving of the paddle motor 30, the stirring paddle 401 rotates. The stirring paddle 401 rotates so that the waste toner in the waste toner box 40 is conveyed in a direction toward the detection unit 402 and the height thereof is leveled to be substantially uniform.

The detection unit 402 detects the waste toner. For example, when the waste toner moves into the waste toner box 40 from the waste toner introduction port 404, the amount of the waste toner in the waste toner box 40 increases. Along with this increase, the amount of the waste toner in the vicinity of the detection unit 402 also increases. As the waste toner accumulates in the vicinity of the detection unit 402, the height thereof also increases. When the height of the waste toner exceeds a threshold, the waste toner is detected by the detection unit 402. The detection unit 402 outputs the detection result of the waste toner to the control unit 21.

The accommodation unit 403 is a space in the waste toner box 40 that is formed by a wall surface or a bottom surface of the waste toner box 40. The accommodation unit 403 accommodates the waste toner.

The waste toner introduction port 404 is an opening portion for introducing the waste toner produced in the image forming apparatus 1 into the accommodation unit 403 in the waste toner box 40. The waste toner introduction port 404 is provided, for example, per cleaner of the image forming unit 14. Specifically, the waste toner introduction port 404 may be provided for each of the transfer cleaner 147 and the photoreceptor cleaner 1405 of each of the photoreceptors. In a specific example of FIG. 4, the waste toner produced by the transfer cleaner 147 moves into the waste toner box 40 through a waste toner introduction port 404_5. The waste toner produced by the yellow photoreceptor cleaner 1405_1 moves into the waste toner box 40 through a waste toner introduction port 404_1. The same can also be applied to waste toner introduction ports 404_2, 404_3, and 404_4.

Next, a control of the paddle motor 30 by the control unit 21 during the image formation of the image forming apparatus 1 will be described. The control unit 21 counts the amount of toner replenished from each of the toner cartridges 145 to the developing device 1404 as a replenishment amount per type of toner. In the embodiment, as the value representing the replenishment amount, the driving time of the replenishment motor 146 is counted. As the value representing the replenishment amount, the rotation speed of the replenishment motor 146 may be counted, or another value may be used. Hereinafter, the value counted as the value representing the replenishment amount will be referred to as "count value".

When the control unit 21 acquires a count value, the control unit 21 acquires a correction factor relating to the count value. The correction factor is a value used for correcting the count value. The correction factor includes at least an environment correction factor. The correction factor may further include another type of correction factor. For example, the correction factor may further include a toner correction factor in addition to the environment correction factor.

The environment correction factor is a correction factor corresponding to environment information that is obtained by the environmental sensor 22 when the count value is obtained. The environment correction factor corresponding to the environment information may be stored in the storage unit 20 in advance. For example, When the environment information obtained by the environmental sensor 22 is information regarding a humidity, an environment correction factor corresponding to the humidity is obtained. The environment correction factor may be obtained such that, as the value of the humidity increases, the count value increases. The environment correction factor may be obtained such that, as the value of the humidity increases, the count value decreases. For example, When the environment information obtained by the environmental sensor 22 is information regarding a temperature, an environment correction factor corresponding to the temperature is obtained. The environment correction factor may be obtained such that, as the value of the temperature increases, the count value increases. The environment correction factor may be obtained such that, as the value of the temperature increases, the count value decreases. For example, When the environment information obtained by the environmental sensor 22 is information regarding a humidity and a temperature, an environment correction factor corresponding to the humidity and the temperature is obtained. A relationship between the environment correction factor and the environment information may be predetermined, for example, depending on the design or type of the image forming apparatus 1.

The toner correction factor is a correction factor corresponding to the type of toner that is used for forming an image when the count value is obtained. The toner correction factor corresponding to the type of toner may be stored in the storage unit 20 in advance.

The control unit 21 corrects the obtained count value using the correction factor. As the value of the correction factor increases, a higher value is obtained as the corrected count value. The control unit 21 updates a cumulative count value using the corrected count value. For example, the control unit 21 may update the cumulative count value by adding the corrected count value to the cumulative count value before update. The cumulative count value is a common value that is used irrespective of the environment information or the type of toner.

The toner correction factor is set based on a standard relating to toner. For example, the toner correction factor may be set depending on a position of the waste toner introduction port 404. Specifically, as the height of the position of the waste toner introduction port 404 is lowered, a higher toner correction factor may be set. The reason for this is that, as the height of the position of the waste toner introduction port 404 decreases, a peak of the waste toner may reach the height of the waste toner introduction port 404 although the amount of the waste toner is small. By setting the toner correction factor as described above, the stirring paddle 401 rotates and the peak of the waste toner is leveled according to a toner having a lower height at the position of the waste toner introduction port 404. As a result, the peak of the waste toner does not reach the waste toner introduction port 404, and hindrance of introduction of the waste toner can be effectively prevented.

For example, the toner correction factor may be set depending on whether or not the type of toner is a toner that is used in combination with another type of toner in the intermediate transfer belt 144. Specifically, when the type of toner is a toner that is used in combination with another type of toner in the intermediate transfer belt 144, a higher toner correction factor may be set as compared to a toner that is not used in combination with another type of toner. Specific examples of the toner that is used in combination with another type of toner include a plurality of toners (C, M, Y) that is used for color printing. Specific examples of the toner that is not used in combination with another type of toner include a toner (K) that is used for monochrome printing. When this toner is used in combination with another type of toner, reverse transfer may occur. When reverse transfer occurs, another type of toner is also introduced from the waste toner introduction port 404 as the waste toner, and the amount of the waste toner introduced from the waste toner introduction port 404 increases. Therefore, although the replenishment amount is small, the peak of the waste toner may reach the height of the waste toner introduction port 404. By setting the toner correction factor as described above, the stirring paddle 401 rotates and the peak of the waste toner is leveled according to the toner that is used in combination with another type of toner. As a result, the peak of the waste toner does not reach the waste toner introduction port 404, and hindrance of introduction of the waste toner can be effectively prevented. On the other hand, by setting the toner correction factor of the toner that is not used in combination with another type of toner to be relatively low, the waste toner is not actively conveyed to the detection unit 402 and is prevented from being detected early.

For example, when the type of toner is a toner that is used in combination with another type of toner in the intermediate transfer belt 144, as the toner is positioned at a more downstream position in the intermediate transfer belt 144, a higher toner correction factor may be set. The reason for this is that, as the toner is positioned at a more downstream position in the intermediate transfer belt 144, reverse transfer is more likely to occur and the amount of the waste toner increases due to reverse transfer.

For example, the correction factor may be set depending on whether or not the photoconductive drum 1401 in a standby state abuts against the intermediate transfer belt 144. Specifically, in the case of a toner (hereinafter, referred to as "abutting toner") for which the photoconductive drum 1401 in a standby state abuts against the intermediate transfer belt 144, a lower correction factor may be set as compared to a toner (hereinafter, referred to as "distant toner") for which the photoconductive drum 1401 in a standby state does not abut against the intermediate transfer belt 144. In the case of the abutting toner, there is no change in position between the photoconductive drum 1401 and the intermediate transfer belt 144 during a period from the standby state to image formation. Therefore, the waste toner is not produced. On the other hand, in the case of the distant toner, there is a change in position between the photoconductive drum 1401 and the intermediate transfer belt 144 during a period from the standby state to image formation because they abut against each other. At this abutting timing, the waste toner may be produced. Accordingly, the amount of the waste toner produced in the case of the distant toner may be more than that in the case of the abutting toner. By setting a higher correction factor for the distant toner based on the above-described circumstances, the waste toner may be leveled more appropriately.

For example, for the configurations illustrated in FIGS. 3 and 4, the correction factor may be set as described below based on the above-described circumstances. For example, when the count value is 50 for each of various types of toners, the correction is executed once.

1) Environment Correction Factor a) When the humidity is 50% or higher and lower than 75%

Environment correction factor of K: 1.0 times
Environment correction factor of C: 1.0 times
Environment correction factor of M: 1.0 times
Environment correction factor of Y: 1.0 times
Environment correction factor of monochrome printing: 1.0 times b) When the humidity is 75% or higher and lower than 100%

Environment correction factor of K: 1.4 times
Environment correction factor of C: 1.4 times
Environment correction factor of M: 1.2 times
Environment correction factor of Y: 1.0 times
Environment correction factor of monochrome printing: 1.1 times 2) Toner Correction Factor Toner correction factor of K: 1.0 times
Toner correction factor of C: 1.8 times
Toner correction factor of M: 1.6 times
Toner correction factor of Y: 1.5 times For example, when the humidity is 75%, in the related art, the cumulative count value is obtained as follows: 50+50+50+50=200. In the embodiment, the cumulative count value is obtained as follows: $50\times1.0\times1.4+50\times1.8\times1.4+50\times1.6\times1.2+50\times1.5\times1.0=367$. Therefore, when color printing is executed, the stirring paddle 401 rotates at an earlier timing. On the other hand, when the monochrome printing is executed, the cumulative count value is obtained as 50 in the related art. In the embodiment, the cumulative count value is obtained as $50\times1.1=55$. This way, even in the case of monochrome printing, a more appropriate count value is obtained depending on environments. On the other hand, in monochrome printing in which the humidity is 50%, the toner correction factor of K is 1.0 times, and there is no difference in cumulative count value between the related art and the embodiment. Accordingly, the stirring paddle 401 can be prevented from rotating at an unnecessarily early timing depending on the environment information or the type of printing.

Figure 5:
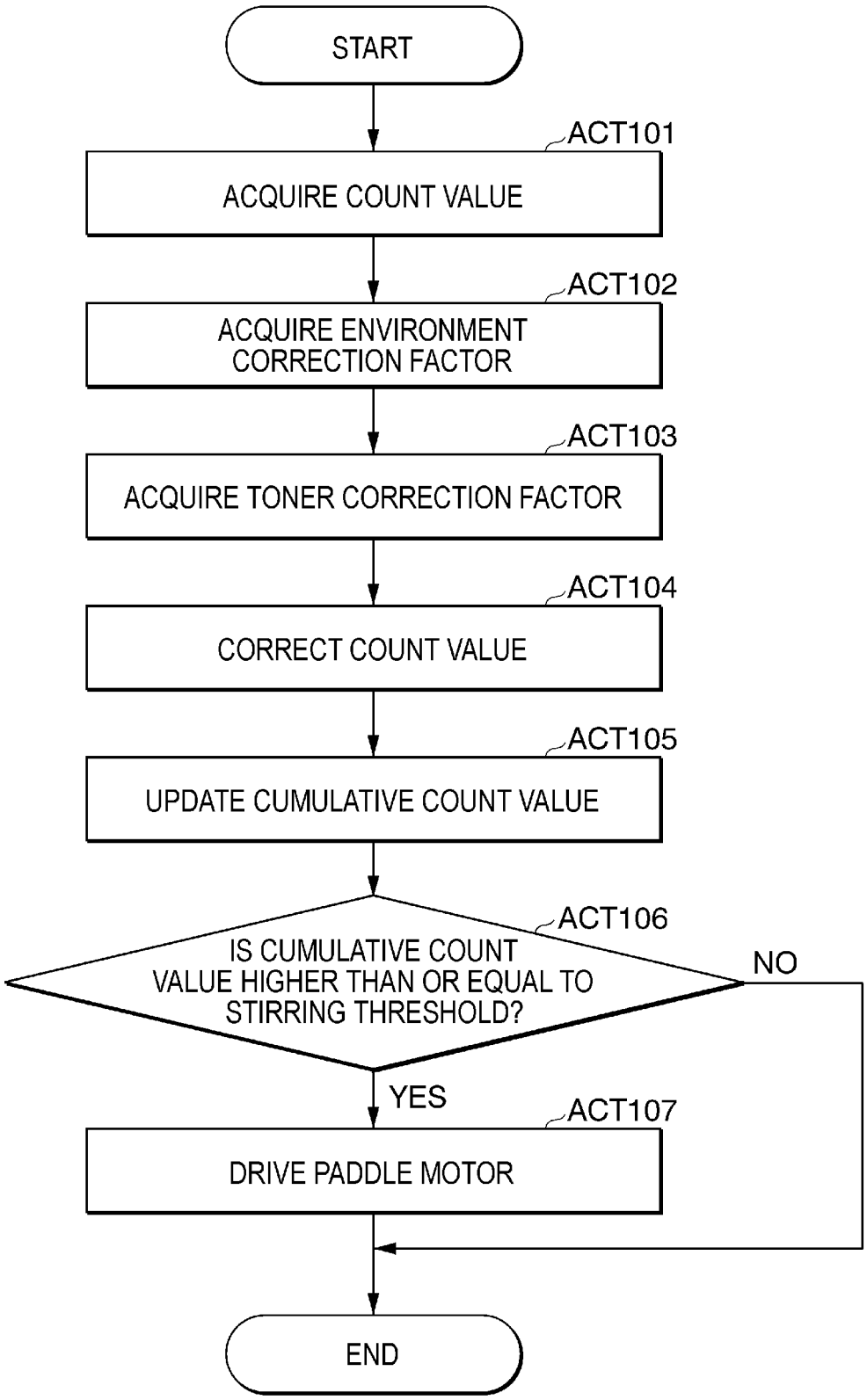
FIG. 5 is a flowchart illustrating a specific example of the flow of operations of the image forming apparatus according to the embodiment.

FIG. 5 is a flowchart illustrating a specific example of the flow of operations of the image forming apparatus 1 according to the embodiment. When a standard representing that the amount of toner in the developing device 1404 is small is satisfied, the control unit 21 drives the replenishment motor 146 corresponding to the type of toner that satisfies the standard. In response to the driving of the replenishment motor 146, the toner is replenished to the developing device 1404 in which the amount of the toner is small. The control unit 21 acquires a count value in response to the driving of the replenishment motor 146 (ACT 101). The control unit 21 acquires an environment correction factor corresponding to environment information at this time (ACT 102). In addition, the control unit 21 acquires a toner correction factor corresponding to the replenished toner (ACT 103). The control unit 21 corrects the count value using the acquired correction factor (ACT 104). The control unit 21 updates a cumulative count value using the corrected count value (ACT 105). The control unit 21 determines whether or not the updated cumulative count value is higher than or equal to a stirring threshold (ACT 106). When the updated cumulative count value is lower than the stirring threshold (ACT 106-NO), the process ends as it is. On the other hand, when the updated cumulative count value is higher than or equal to the stirring threshold (ACT 106—YES), the control unit 21 drives the paddle motor 30 to rotate the stirring paddle 401 (ACT 107).

With this configuration, in the waste toner box 40 that is an example of the waste toner collection container, the waste toner can be effectively collected. Specifically, the correction factor corresponding to the environment information is determined, and the count value is corrected using this correction factor. As a result, the count value corresponding to the environment information can be obtained. Therefore, the rotation of the stirring paddle 401 can be controlled depending on accumulation characteristics of the waste toner corresponding to the environment information. In addition, the correction factor is determined per type of toner, and the count value is corrected using the correction factor. As a result, the count value corresponding to the type of toner can be obtained. Therefore, the rotation of the stirring paddle 401 can be controlled depending on accumulation characteristics of the waste toner corresponding to the type of toner.

In the above-described example, when the count value is 50 for each of various types of toners, the correction is executed once. However, the embodiment is not limited to this example. For example, the count is executed based on the ON time of the replenishment motor 146, and when the replenishment motor 146 is turned off, the count is stopped. The correction may be executed by multiplying the count value obtained at this time by the correction factor.

In addition, in the above-described example, the count value is corrected using the environment correction factor and the toner correction factor. However, one correction factor may be determined in advance depending on a combination of environment information and toner information.

In addition, the correction factor may be determined depending on a printing ratio during printing. For example, as the printing ratio increases, a higher correction factor correlating to the printing ratio may be determined. With this configuration, the rotation of the stirring paddle 401 can be controlled more accurately depending on the printing ratio. That is, as the printing ratio increases, the amount of toner used increases, and thus reverse transfer is more likely to occur. Therefore, as the printing ratio increases, the amount of waste toner is likely to increase. By executing the above-described control, a control relating to the waste toner can be executed more accurately for the possibility.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such embodiments or modifications as would fall within the scope and spirit of the invention.

For example, the correction factor may be set or changed by a manager of the image forming apparatus 1 or a person who executes maintenance.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

an image forming component configured to form a toner image on a sheet using a toner that is replenished from a toner cartridge previously containing the toner;

an environmental sensor configured to acquire information regarding an environment around the image forming component;

a waste toner collection container configured to hold a waste toner produced in the image forming component;

a paddle motor configured to rotate a stirring paddle provided in the waste toner collection container;

a storage component configured to store a correction factor corresponding to the information regarding the environment acquired by the environmental sensor; and a controller configured to acquire a count value relating to a replenishment amount when the toner is replenished from the toner cartridge to the image forming component, to correct the count value with the correction factor corresponding to the information regarding the environment, to update a cumulative count value with the corrected count value, and to drive the paddle motor according to the updated cumulative count value.

2. The image forming apparatus according to claim 1, wherein the environmental sensor comprises a humidity sensor configured to measure a humidity.

3. The image forming apparatus according to claim 1, wherein the environmental sensor comprises a temperature sensor configured to measure a temperature.

4. The image forming apparatus according to claim 1, wherein the environmental sensor comprises a temperature sensor configured to measure a temperature and a humidity sensor configured to measure a humidity.

5. The image forming apparatus according to claim 1, wherein the storage component further stores a correction factor corresponding to a type of the toner in addition to the information regarding the environment, and the controller corrects the count value with the correction factor corresponding to the information regarding the environment and the type of the toner.

6. The image forming apparatus according to claim 5, wherein the correction factor is determined depending on a position of a waste toner introduction port as an opening portion through which the toner is introduced from the image forming component into the waste toner collection container.

7. The image forming apparatus according to claim 5, wherein the correction factor is determined depending on a position of a developing device where the toner is used.

8. The image forming apparatus according to claim 5, wherein the correction factor is determined depending on whether or not the toner is used in combination with a second type of toner.

9. A control method for an image forming apparatus including an image forming component configured to form a toner image on a sheet using a toner that is replenished from a toner cartridge previously containing the toner, an environmental sensor configured to acquire information regarding an environment around the image forming component, a waste toner collection container configured to hold a waste toner produced in the image forming component, a paddle motor configured to rotate a stirring paddle provided in the waste toner collection container, and a storage component configured to store a correction factor corresponding to the information regarding the environment acquired by the environmental sensor, the method comprising:

acquiring a count value relating to a replenishment amount when the toner is replenished from the toner cartridge to the image forming component;

correcting the count value with the correction factor corresponding to the information regarding the environment;

updating a cumulative count value with the corrected count value; and driving the paddle motor according to the updated cumulative count value.

10. The control method according to claim 9, further comprising:

measuring a humidity with the environmental sensor.

11. The control method according to claim 9, further comprising:

measuring a temperature with the environmental sensor.

12. The control method according to claim 9, further comprising:

measuring a temperature and a humidity with the environmental sensor.

13. The control method according to claim 9, further comprising:

storing a correction factor corresponding to a type of the toner in addition to the information regarding the environment, and correcting the count value with the correction factor corresponding to the information regarding the environment and the type of the toner.

14. The control method according to claim 13, further comprising:

determining the correction factor depending on a position of a waste toner introduction port as an opening portion through which the toner is introduced from the image forming component into the waste toner collection container.

15. The control method according to claim 13, further comprising:

determining the correction factor depending on a position of a developing device where the toner is used.

16. The control method according to claim 13, further comprising:

determining the correction factor depending on whether or not the toner is used in combination with a second type of toner.

17. A toner handling device, comprising:

an environmental sensor configured to acquire information regarding an environment around an image forming component configured to form a toner image on a sheet using a toner that is replenished from a toner cartridge previously containing the toner;

a waste toner collection container configured to hold a waste toner produced while forming the toner image;

a paddle motor configured to rotate a stirring paddle provided in the waste toner collection container;

a storage component configured to store a correction factor corresponding to the information regarding the environment acquired by the environmental sensor; and a controller configured to acquire a count value relating to a replenishment amount when the toner is replenished from the toner cartridge to the image forming component, to correct the count value with the correction factor corresponding to the information regarding the environment, to update a cumulative count value with the corrected count value, and to drive the paddle motor according to the updated cumulative count value.

18. The toner handling device according to claim 17, wherein the storage component further stores a correction factor corresponding to a type of the toner in addition to the information regarding the environment, and the controller corrects the count value with the correction factor corresponding to the information regarding the environment and the type of the toner.

19. The toner handling device according to claim 18, wherein the correction factor is determined depending on a position of a waste toner introduction port as an opening portion through which the toner is introduced from the image forming component into the waste toner collection container.

20. The toner handling device according to claim 18, wherein the correction factor is determined depending on a position of a developing device where the toner is used.

* * * * *